US005679491A

United States Patent [19]

Oshiba et al.

[11] Patent Number: 5,679,491

[45] Date of Patent: Oct. 21, 1997

[54] TONER USED FOR DEVELOPING AN ELECTROSTATIC CHARGE IMAGE

[75] Inventors: Tomomi Oshiba; Kenji Yamane; Hatsumi Yamada; Yuji Marukawa, all of Hachioji, Japan

[73] Assignee: Konica Corporation, Japan

[21] Appl. No.: 759,947

[22] Filed: Dec. 3, 1996

[30] Foreign Application Priority Data

Dec. 7, 1995 [JP] Japan ..... 7-319210

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 3,925,219 | 12/1975 | Strong | 430/111 |
| 4,937,157 | 6/1990 | Haack et al. | 430/110 |
| 5,085,963 | 2/1992 | Suzuki et al. | 430/110 |
| 5,114,821 | 5/1992 | Haack | 430/110 |
| 5,565,294 | 10/1996 | Sawai et al. | 430/111 |

*Primary Examiner*—Roland Martin

*Attorney, Agent, or Firm*—Jordan B. Bierman; Bierman, Muserlian and Lucas LLP

[57] ABSTRACT

A toner used for developing an electrostatic charge image containing a coloring agent, a quaternary ammonium salt compound and polyolefin is disclosed. The quaternary ammonium salt compound is represented by formula (A) and have solubility to water of not more than 2.0%, and number-averaged dispersed diameter of polyolefin is 0.1 μm–1.0 μm. The toner satisfies formula (1);

$$17<D_T/D_{CCA}<90 \quad (1)$$

wherein, $D_T$ is a volume-averaged particle size of the toner particle, and $D_{CCA}$ represents a number-averaged diameter of quaternary ammonium salt compound dispersed in a toner particle.

Formula (A)

The definition is described in the specification.

6 Claims, 2 Drawing Sheets

TONER USED FOR DEVELOPING AN ELECTROSTATIC CHARGE IMAGE

BACKGROUND OF THE INVENTION

The present invention relates to toner and an image forming method using the same, and in particular, to toner containing therein at least a charge controlling agent and a release agent and to an image forming method using the same.

Heretofore, an electrophotographic method used for an image forming method of a copying machine has been represented by a method wherein a photoreceptor composed of a photosensitive layer containing a photo-conductive material is given uniform static charges, then, the photoreceptor is subjected to imagewise exposure so that an electrostatic latent image corresponding to an original is formed on the surface of the photoreceptor, and the electrostatic latent image is developed by a developing agent to turn into a toner image which is further fixed after being transferred onto a recording material such as a sheet of paper.

Recently, there have been demands of high precision and high image quality for a printer and a copying machine, which therefore has led to an attempt to obtain high image quality by making a particle size of toner small. When a particle size of toner is small, the surface area per unit weight of the toner is large, resulting in that chargeability and powder characteristics of the toner are affected by its surface characteristics. Namely, it is the technical main point in toner with a small particle size to control its surface conditions.

With regard to a charge controlling agent which has been used commonly for toner of a copying machine, there have been available azo metal complex and chromium-containing metal dye for negative charging, and Nigrosine dye and quaternary ammonium salt for positive charging. These charge controlling agent is subjected to fusion kneading, crushing and classification together with a binding resin, a coloring agent and other additives, to turn into toner having a predetermined particle size. However, these charge controlling agents have, when they are raw materials, a primary particle size that is mostly the same as a toner particle size, or they have a particle size greater than the toner particle size as a coagulated particle. Therefore, they are dispersed in various states in resins in the course of fusion kneading. Therefore, in the steps of crushing and classification thereafter, they are dispersed unevenly in toner or on the surface thereof, or the charge controlling agent itself is crushed and is stuck to the toner surface as a free charge controlling agent, resulting in uneven state on the surface of toner and broad charge amount distribution which cause fog and toner splashing. There is further caused a fall of a charge amount resulted from a soil on the carrier surface caused by charge controlling agents existing in a free state. Attention must be paid in particular to the problems mentioned above in the case of toner with a small particle size, because its specific surface area is large.

On the other hand, a fixing method of a heat roll type is popular as a fixing method affecting fixation property which is another important characteristic of toner. In addition to this, there are known other systems such as a fixing method of a heat plate type and that of a flash fixing type, and what is called a heat roll fixing system or a film-shaped fixing system is preferably used in consideration of a simplified fixing unit. In these fixing systems, fixing is conducted when a support onto which toner has been transferred is caused to pass through the boundary between rolls or between a film and a roll. Accordingly, toner is required to have adhesiveness to paper and release property for a roll or a film.

There has been known a technology for adding a release agent to toner for an improvement of release property. As a release agent, there are known generally low molecular weight polypropylene, low molecular weight polyethylene, olefins such as ethylene-propylene copolymer, microcrystalline wax, carnauba wax, sazole wax and paraffine wax.

However, since most of aforesaid release agents are charged negatively through frictional electrification with general carriers, they inhibit chargeability when they are used for toner to be charged positively, which is a problem. Accordingly, it has been difficult to secure both release property and high chargeability simultaneously in the case of toner to be charged positively.

SUMMARY OF THE INVENTION

An object of the invention is to provide toner with a small particle size satisfying both uniform and high chargeability and release property simultaneously.

Toner used for developing an electrostatic charge image of the invention contains, dispersedly in binding resin, coloring agents, quaternary ammonium salt compound represented by formula (A) having solubility to water of not more than 2.0% and polyolefin whose number-averaged dispersed diameter is 0.1 μm–1.0 μm, and the toner satisfies formula (1);

$$17<D_T/D_{CCA}<90 \quad (1)$$

wherein, $D_T$ is a volume-averaged particle size of a toner particle, and $D_{CCA}$ represents a number-averaged dispersed diameter of quaternary ammonium salt compound dispersed in a toner particle

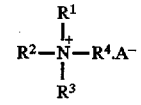

formula (A)

In the above formula, $R^1$, $R^2$, $R^3$ and $R^4$ respectively represent a substituted or unsubstituted alkyl group having 1–18 carbons, or a substituted or unsubstituted benzyl group, provided that at least one of $R^1$, $R^2$, $R^3$ and $R^4$ is an alkyl group having 8–18 carbons, and $A^-$ represents an ation.

The quaternary ammonium salt compound is a charge controlling agent.

This toner is used preferably in an image forming method employing a fixing method wherein a recording material carrying toner images is caused to pass through the boundary between a moving flexing member and a pressure member which rotates while being in pressure contact with the fixing member, and thereby the toner images are heat-fixed on the recording material through the fixing member by a heating member arranged fixedly.

In the image forming method mentioned above, it is preferable, from the viewpoint of higher effect of the invention, that the fixing member is a fixing roller housing therein a heating member or a film-shaped member in the fixing method.

[Explanation of symbols]

Figure 1:
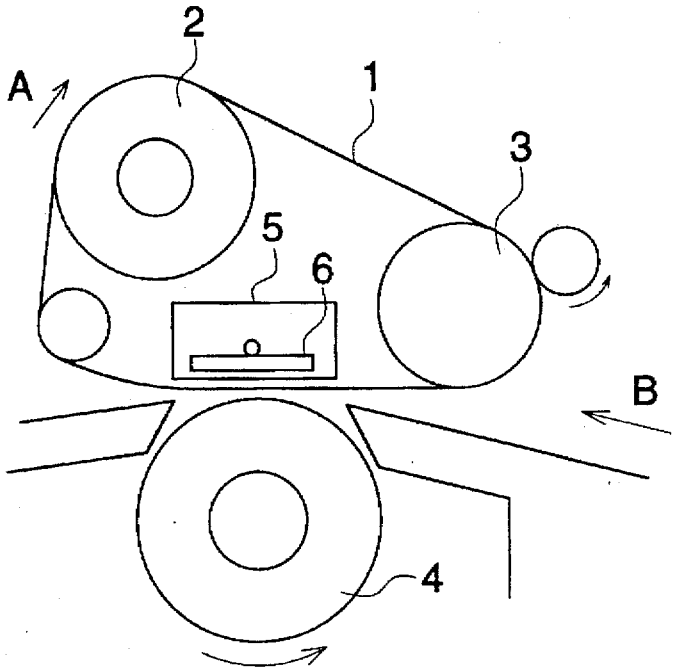
FIG. 1 is a schematic structural diagram showing an example of a fixing means used in an image forming method.

1, 12. Film-shaped member
2. Driving roller
3. Driven roller
4. Pressure roller
5. Low heat capacity line-shaped heating body
11. Supply shaft
13. Take-up shaft
21. Upper roller
23. Metallic cylinder
24. Heating source
25. Lower roller

DETAILED DESCRIPTION OF THE INVENTION

The invention will be explained in detail as follows.

The ammonium compound satisfies formula (1) $17<D_T/D_{CC}<90$ where $D_T$ represents a volume-averaged particle size of a toner particle, and $D_{CCA}$ represents a number-averaged dispersed diameter of a charge controlling agent, that is, the quaternary ammonium salt compound represented by the formula (A) in a toner particle, and it is preferable that the ratio of $D_T/D_{CCA}$ is less than 85., more preferably $D_T/D_{CCa}$ is not less than 25 and not more than 85.

In this case, it is possible to measure the mean volume-averaged particle size of a toner particle by the use of a laser type particle size distribution measuring instrument equipped with a wet type dispersing device (e.g., HELOS: made by Nihon Denshi Co.).

A number-averaged dispersed diameter of an ammonium compound in a toner particle can be obtained through the following method. Namely, in the method, toner is enveloped by resins, then a flake having a thickness of about 0.20 μm is prepared by a microtome, after that, and the flake is cleaned with a solvent which dissolves only an ammonium compound in the flake but not other constituting components of the toner and resins enveloping the toner. Then, the cleaned flake is photographed by a transmission electron microscope to obtain a 430 magnification negative film which is enlarged to prepare a 2,000 magnification photograph. This photograph is subjected to image analyses under an image analyzing apparatus (SPICCA: made by Nihon Abionix Co.) to obtain a number average value of a circle-equivalent diameter of a hole through which ammonium compounds eluted, and this number average value is assumed to be the number-averaged dispersed diameter of the ammonia compound.

Solubility of an ammonia compound to water is defined to be a percentage of residual materials obtained in a following method. Two (2) g of the compound is put in 100 g of water and stirred at ordinary temperature (25° C.) for one hour, then the mixture is filtrated, the filtrated liquid is measured, and then, water is evaporated. The ratio of weight of the residual material to the weight of the filtrated liquid in percent is the solubility of the ammonia compound to water.

A number-averaged dispersed diameter of polyolefin can be obtained through the following method. In the method, toner is enveloped by resins, and a flake having a thickness of about 0.20 μm is prepared by a microtome. Then, the flake photographed by a transmission electron microscope to obtain a 430 magnification negative film which is enlarged to prepare a 2,000 magnification photograph. This photograph is subjected to image analyses under an image analyzing apparatus (SPICCA: made by Nihon Abionix Co.) to obtain a number average value of a circle-equivalent diameter of polyolefin domain which is assumed to be the dispersed diameter.

When those having specific solubility to water are selected from quaternary ammonium salt compounds known as a charge controlling agent and when the dispersed diameter in a toner particle of polyolefin known as a release agent takes a specific value, an excellent effect is produced.

By controlling the dispersed diameter of olefin by causing the dispersed diameter to take a specific value by using quaternary ammonium salt compound having specific constitution for the toner particle, a balance between fixation property and chargeability can be secured in toner to be charged positively.

Namely, when a substance charged negatively through frictional electrification with carriers like a release agent is dispersed in toner together with a charge controlling agent, the dispersed diameter of the charge controlling agent is controlled to be within a narrower range and a charge controlling agent having higher charging ability are used for making both fixation property and chargeability to be compatible.

Examples of concrete quaternary ammonium salt are shown below.

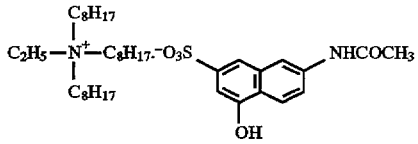
(1)

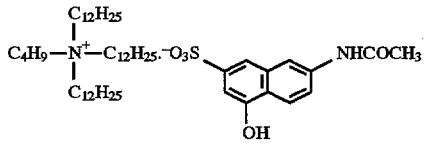
(2)

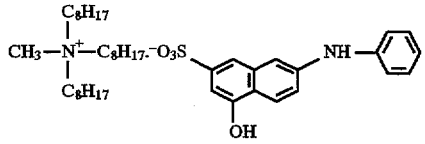
(3)

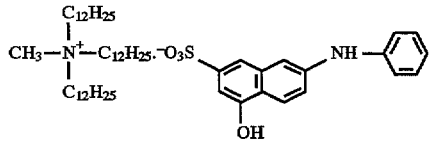
(4)

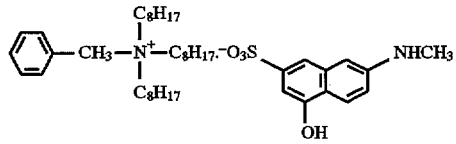
(5)

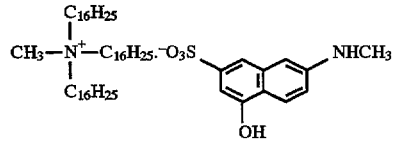
(6)

-continued

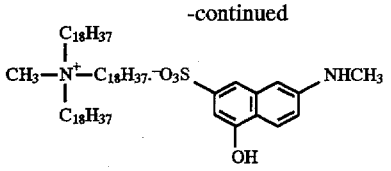

(7)

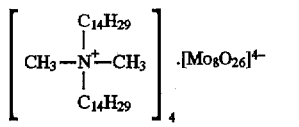

(8)

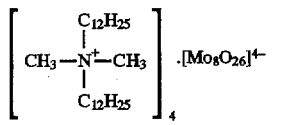

(9)

For making both quaternary ammonium salt compound and polyolefin to be compatible without inhibiting their effects, dispersed diameters of both of them need to be controlled. When a dispersed diameter of polyolefin in toner is 0.1 μm more, sufficient releasing effects are attained in the course of toner fixing, and fixing members are not soiled. For obtaining uniform release agent distribution and for causing no removal of release agent, it is preferable that the dispersed diameter is not more than 1.0 μm.

As for polyolefin, low molecular weight ones are preferable, and low molecular weight polyolefin having number average molecular weight Mn of 800–10,000 and weight average molecular weight of 3,000–50,000 is preferable. In this case, the average molecular weight represents a value obtained through measurement by means of a high temperature gel permeation chromatography (GPC). To be concrete, o-dichrolobenzene to which 0.1% of ionol (product by Shell) is added as a solvent is used, and it is caused to flow out under the condition of temperature of 135° C., and it is detected by a differential refractometer detector, thus, a molecular weight was obtained through a universal calibration method in conversion of absolute molecular weight of polypropylene. When the average molecular weight of polyolefin is lower than aforesaid range, glass transition point of toner is lowered and there sometimes happens a problem such as occurrence of blocking. When the average molecular weight is higher than aforesaid range, on the contrary, release property of toner is lowered, and it is sometimes difficult to secure release property even if the dispersed diameter is controlled.

Polyolefin is composed of a polymer of ethylene and propylene, and preferable ones include low molecular weight polypropylene, low molecular weight polyethylene and ethylenepropylene copolymers.

A manufacturing method for polyolefin is not limited in particular, but there is generally used a method wherein polyolefin synthesized in an ordinary method is subjected, while it is in its melted state, to heat decomposition, to be prepared. For adjustment of molecular weight, it is possible to use a method for fractionating and adjusting so that. polyolefin may have an average molecular weight and distribution within a preferable range in aforesaid GPC.

A dispersed diameter of polyolefin can be regulated by controlling the average filling rate of kneaded substance in a kneading zone in a kneading apparatus in a kneading process within a range of 240–400 kg/cm$^3$ and by making its fluctuation width to be ±10% or less. With regard to an amount of polyolefin to be added, it is preferable to add it in toner at the rate of 1-5% by weight.

It is normal that the toner contains binding resins and coloring agents in addition to the compounds mentioned above. There is no limitation in particular for the binding resins, and various resins which have been known may be used. For example, styrene resins, acrylic resins, styrene-acrylic resins and polyester resins are cited. Further, coloring agents are not limited, in particular, and various conventional known materials can be used. For example, carbon black, Nigrosine dyes, aniline blue, charcoil blue, chrome yellow, ultramarine blue, Du Pont oil red, quinoline yellow, methyleneblue chloride, phthalocyanine blue, Malachite Green oxalate and rose Bengal are cited.

Toner particles are sometimes used as they are as toner, and it is usual that external agents such as inorganic fine grains are added thereto from the viewpoint of fluidizing. Preferable inorganic fine grains include preferably inorganic oxide grains such as silica, titania and alumina, which may further be processed to be hydrophobic by silane coupling agent or a titanium coupling agent. Primary particle sizes of these inorganic fine grains are preferably within a range of 5–300 nm. Further, it is preferable that the rate of adding these inorganic fine grains is 0.1–2% by weight per toner.

These external agents are sometimes in the state of sticking to the surface of a toner particle, or are in the state of mixing with coloring grains without sticking thereto, or are in the state .where aforesaid both states exist.

The toner can be used either as a two-component developing agent or as a magnetic mono-component developing agent.

When the toner is used as a two-component developing agent, it is used after being mixed with a carrier. A carrier to be used in this case includes a non-coated carrier composed only of magnetic material grains such as iron or ferrite, a resin-coated carrier wherein the surface of a magnetic material grain is coated with resins, and a resin-dispersed type carrier obtained by mixing magnetic powder with resins. An average particle size of this carrier is preferably 30–150 μm in terms of volume-averaged particle size.

When the toner is used as a magnetic mono-component developing agent, it is preferable that ferromagnetic substance such as magnetite having number-averaged primary particle size of 0.1–2.0 μm is contained in the mono-component developing agent as a coloring agent. In this case, 20–60% by weight of magnetic substances are added to toner.

It is further possible to use this toner as non-magnetic mono-component toner composed only of non-magnetic toner without using a carrier.

In a preferable fixing method used in an image forming method, a recording material carrying toner images is caused to pass through the boundary between a moving fixing member and a pressure member that rotates while being in pressure contact with aforesaid fixing member, and thereby the toner images are heat-fixed on the recording material through the fixing member by a heating member arranged fixedly. A fixing method wherein a fixing member is either a fixing roller housing therein a heating member or a film-shaped member is more preferable.

In a fixing method employing a fixing roller, there are arranged an upper roller having a heat source inside a metallic cylinder composed of iron or aluminum coated on its surface with tetrafluoroethylene or polytetrafluoroethylene-per-fluoroalkoxyvinylether copolymer and a lower roller formed with silicone rubber or the like. To be more exact, a wire-shaped heater is provided as a heat source, and it heats so that the surface temperature of the upper roller may be kept at about 120°–200° C. In the fixing section, the upper roller and the lower roller are brought into pressure contact with each other, and thereby the lower roller is deformed to form the so-called nip. A nip width is preferably 1–10 mm, and the more preferable is 1.5–7 mm. The linear speed for fixing is preferably 40–400 ns/sec. When the nip width is too small, heat can not be transferred uniformly to toner, resulting in occurrence of fixing marks. When the nip width is too great, resin fusion is accelerated, resulting in occurrence of a problem of excessive fixing offset.

FIG. 1 shows schematic structure of an example of a fixing means used in the image forming method. In the means shown in FIG. 1, a moving fixing member is a film-shaped member, and endless-film-shaped member 1 is wound around driving roller 2 and driven roller 3 to be moved in the direction of arrow A. A recording material (unillustrated) carrying toner images is caused to pass through the boundary between the film-shaped member 1 and pressure roller 4 which is a pressure member that rotates while being in pressure contact with the film-shaped member 1 in the direction of arrow B, so that the toner images are heated for heat-fixing by low heat capacity line-shaped heating body 5 which is a heating member arranged fixedly. The numeral 6 is a heat generator for heating the low heat capacity line-shaped heating body 5.

Figure 2:
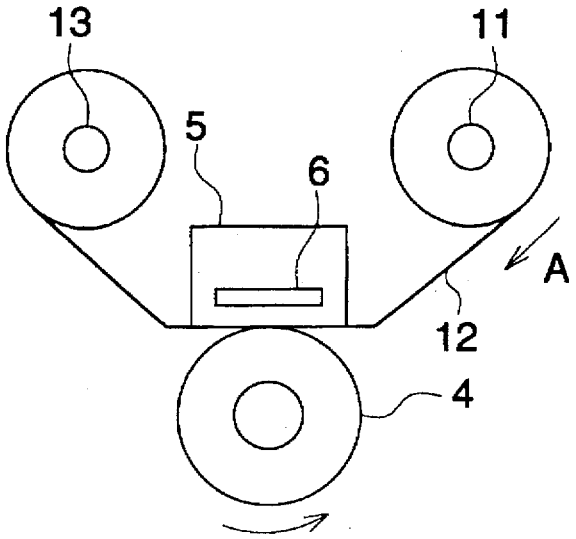
FIG. 2 is a schematic structural diagram showing another example of the fixing means used in an image forming method.

FIG. 2 shows an example wherein a film-shaped member with ends is used in place of the endless-film-shaped member, which is the same as the example shown in FIG. 1 except that film-shaped member 12 is wound around supply shaft 11 and moves when it is taken up by take-up shaft 13. It is further possible to support and move a film-shaped member with a merely cylindrical object, without providing a driving roller and a driven roller.

In the fixing method wherein a film-shaped member is used as a fixing member, it is possible to use, for example, a low heat capacity line-shaped heating body as a heating member fixed on an apparatus. The line-shaped heating body is one wherein resistance material is coated to form a width of 1.0–2.5 mm on an alumina substrate having a preferable thickness of 0.2–5.0 mm (more preferable is 0.5–3.5 mm), a width of 10–15 mm and a length of 240–400 mm, and it generates heat when it is electrified from its both ends. Electrifying is conducted by changing, for example, to the pulse width of D.C. 100 V and frequency of 25 msec. In the low heat capacity line-shaped heating body, when the temperature detected by a temperature sensor is $T_1$, surface temperature $T_2$ of the film-shaped member facing aforesaid resistance material is lower than $T_1$. In this case, it is preferable that $T_1$ is 120°–220° C., and $T_2$ is lower than $T_1$ by 0.5°–10° C. Surface temperature $T_3$ of the film-shaped member at the portion where the film-shaped member is released from the toner fixing surface is mostly the same as $T_2$. The film-shaped member representing a fixing member is moved in the direction of arrow A on the figure while being in contact with the heating member thus controlled in terms of energy and temperature.

As a film-shaped member, it is possible to use a heat resistant film having a thickness of 10–35 μm, such as, for example, an endless film wherein a releasing material layer in which a conductive material is contained in fluorine-contained resin such as Teflon is coated to the thickness of 5–15 μm on polyester, polyperfluoroalkoxyvinylether, polyimide, or polyetherimide, for example. In general, the total thickness of the film-shaped member is 10–100 μm and it is conveyed in the direction of arrow A, being free from a crease or a twist, by driving and tension of a driving roller and a driven roller for the film-shaped member. It is preferable that the fixing linear speed is 40–400 mm/sec. A pressure roller has an elastic layer made of rubber with high release property such as silicone rubber, and it applies pressure of 2–30 kg on a heating member through the film-shaped member, and rotates while being in pressure contact.

There is no limitation, in particular, for a method of fixing toner, and it is possible to use a method employed generally. Let a heat roller fixing method be explained as an example of a method of fixing toner, referring to FIG. 3. A fixing section is composed of upper roller 21 wherein heating source 24 is housed in metallic cylinder 23 made of iron or aluminum coated on its surface with, for example, tetrafluoroethylene or with polytetrafluoroethylene-perfluoroalkylvinylether copolymer and of lower roller 25 made of silicone rubber or the like. To be more exact, the heating source 24 has a wire-shaped heater which heats the upper roller 21 so that its surface temperature may rise to about 10°–220° C. Through the boundary between the upper roller 21 and the lower roller 25, recording material 26 carrying toner image 27 in the invention is caused to pass so that the toner image 27 may be fused and fixed on the recording material. In the fixing section, the upper roller 21 and lower roller 25 are caused to be in pressure contact with each other, and the lower roller 25 is deformed accordingly, resulting in formation of what is called a nip. A nip width is 1–10 mm, and the preferable is 1.5–7 mm. The fixing linear speed is preferably 40–400 m/sec. When the nip width is too small, heat can not be transferred to toner uniformly, resulting in a tendency toward occurrence of fixing marks. When the nip width is too large, on the other hand, toner fusion is accelerated and offset phenomena tend to occur accordingly.

In the heat roller fixing method, a silicone oil coating film described in Japanese Patent Publication Open to Public Inspection No. 114941/1996 (hereinafter referred to as Japanese Patent O.P.I. Publication) is formed on surface 22 of the upper roller 21. An example of forming the silicone oil coating film on the surface 22 of the upper roller 21 is shown. below.

Namely, impregnated roller 28 is in pressure contact with the longitudinal surface 22 of the upper roller 21 and is rotating in the arrowed direction. The impregnated roller 28 is impregnated with aforesaid silicone oil in advance, and when the upper roller 21 rotates in the course of fixing, the silicone oil is supplied in driblets to the surface of the upper roller 21 from the impregnated roller 28, resulting in formation of aforesaid silicone oil coating film on the surface 22 of the upper roller 21.

EXAMPLE

Next, the invention will be explained concretely as follows, referring to an example.

Manufacture of toner

Colored grains having a prescribed volume-averaged particle size were prepared through mixing, fusion kneading, crushing and classification conducted under the composition shown in Table 1 or Table 2, and these grains were mixed with hydrophobic silica at the rate of 100 parts by weight of the grains to 1 part by weight of hydrophobic silica to prepare toner. Table 1 shows $D_T$, $D_{CCA}$ and $D_T/D_{CCA}$ of charge controlling agent, dispersed diameter ($D_w$) of release agent and solubility (S) of charge controlling agent to water at 25° C. incidentally, meanings of symbols in a column of release agent in Table 1 are as follows.

PE1: Polyethylene with Mn=4200 and Mw=7500
PE2: Polyethylene with Mn=4500 and Mw=8400
PE3: Polyethylene with Mn=4700 and Mw=8800
PP1: Polypropylene with Mn=2900 and Mw=6500
PP2: Polypropylene with Mn=3300 and Mw=6400
PP3: Polypropylene with Mn=3700 and Mw=6500

TABLE 1

| Toner No. | Resins | Coloring agents | Charge controlling agents | Release agents | $D_T$ (μm) | $D_{CCA}$ (μm) | $D_T/D_{CCA}$ | $D_W$ (μm) | S (%) |
|---|---|---|---|---|---|---|---|---|---|
| 1 | PEs 100 parts | CB 10 parts | Compound 5 1 part | PE1 4 parts | 8.5 | 0.50 | 17.0 | 0.70 | 0.1 |
| 2 | StAc 100 parats | CB 10 parts | Compound 3 1 part | PP1 4 parts | 8.5 | 0.36 | 23.6 | 0.41 | under 0.1 |
| 3 | PEs 100 parts | CB 10 parts | Compound 2 1 part | PP2 4 parts | 8.5 | 0.10 | 85.0 | 0.90 | 0.2 |
| 4 | StAc 100 parts | CB 10 parts | Compound 8 1 part | PP1 4 parts | 8.5 | 0.10 | 85.0 | 0.50 | under 0.1 |
| 5 | StAc 100 parts | CB 10 parts | Compound 4 1 part | PP3 4 parts | 8.0 | 0.30 | 26.7 | 0.53 | under 0.1 |
| 6 | PEs 100 parts | CB 10 parts | Compound 9 1 part | PP2 4 parts | 8.0 | 0.09 | 88.9 | 0.72 | under 0.1 |
| 7 | PEs 100 parts | CB 10 parts | Compound 7 1 part | PE2 4 parts | 7.5 | 0.20 | 37.5 | 0.68 | 0.1 |
| 8 | StAc 100 parts | CB 10 parts | Compound 6 1 part | PE3 4 parts | 5.5 | 0.10 | 55.0 | 0.24 | 0.1 |
| 9 | PEs 100 parts | Magnetic powder 45 parts | Compound 1 1 part | PP1 4 parts | 8.5 | 0.40 | 21.3 | 0.63 | 0.2 |
| 10 | StAc 100 parts | Magnetic powder 45 parts | Compound 6 1 part | PE2 4 parts | 7.5 | 0.15 | 50.0 | 0.28 | 0.1 |
| 11 | StAc 100 parts | Magnetic powder 45 parts | Compound 2 1 part | PP2 4 parts | 5.5 | 0.08 | 68.8 | 0.22 | 0.2 |

TABLE 2

| Toner No. | Resins | Coloring agents | Charge controlling agents | Release agents | $D_T$ (μm) | $D_{CCA}$ (μm) | $D_T/D_{CCA}$ | $D_W$ (μm) | S (%) |
|---|---|---|---|---|---|---|---|---|---|
| 12 | PEs 100 parts | CB 10 parts | Comparative CCA1 1 part | PE1 4 parts | 8.5 | —* | ∞ | 0.09 | under 0.1 |
| 13 | StAc 100 parts | CB 10 parts | Comparative CCA1 1 part | PP1 4 parts | 8.5 | 0.92 | 9.2 | 0.48 | 4.5 |
| 14 | StAc 100 parts | CB 10 parts | Compound 2 1 part | PP2 4 parts | 7.5 | 0.30 | 25.0 | 1.35 | 0.2 |
| 15 | PEs 100 parts | CB 10 parts | Compound 6 1 part | PP3 4 parts | 5.5 | 0.40 | 13.8 | 0.05 | 0.1 |
| 16 | PEs 100 parts | Magnetic powder 45 parts | Comparative CCA1 1 part | PE1 4 parts | 8.5 | —* | ∞ | 0.08 | under 0.1 |
| 17 | PEs 100 parts | Magnetic powder 45 parts | Comparative CCA2 1 part | PP1 4 parts | 8.0 | 0.09 | 88.9 | 0.75 | 4.5 |
| 18 | StAc 100 parts | Magnetic powder 45 parts | Compound 1 1 part | PE2 4 parts | 7.5 | 0.50 | 15.0 | 1.40 | 0.1 |
| 19 | StAc 100 parts | Magnetic powder 45 parts | Compound 5 1 part | PP2 4 parts | 5.5 | 0.40 | 13.8 | 0.59 | 0.1 |

Note
*denotes that no coagulation of charge controlling agent is not observed.

In Table 2, $PE_s$ represents polyester, StAc represents streneacrylic resin and CB represents carbon black.

With regard to aforesaid toner 1—toner 6 and toner 12—toner 15, they were mixed with ferrite carrier coated with styreneacrylic resin having a volume-averaged particle size of 60 μm to be used as a developing agent having toner concentration of 5%. With regard to toner 7—toner 9 and toner 16—toner 19, on the other hand, they were used as a magnetic mono-component developer composed of toner only.

Structural formulas of charge controlling agents CCA1 and CCA-2 are as follows.

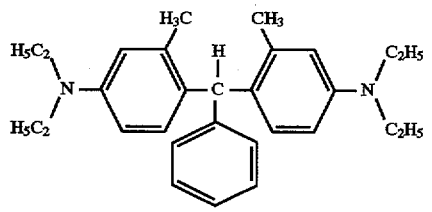

CCA1

-continued

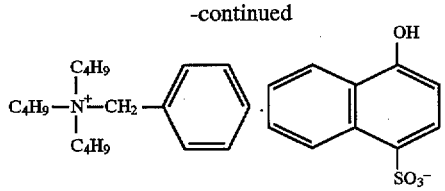

CCA2

Evaluation

With regard to aforesaid toner 1—toner 6 and toner 12—toner 15, they were evaluated as a two-component developer on a copying machine which was the copying machine U-Bix x 3035 made by Konica Corp. wherein a fixing unit was modified.

With regard to toner 7—toner 9 and toner 16—toner 19, they were evaluated on a printer obtained by modifying the laser beam printer LP-3015 made by Konica Corp.

Conditions for fixing were as follows.

Figure 3:
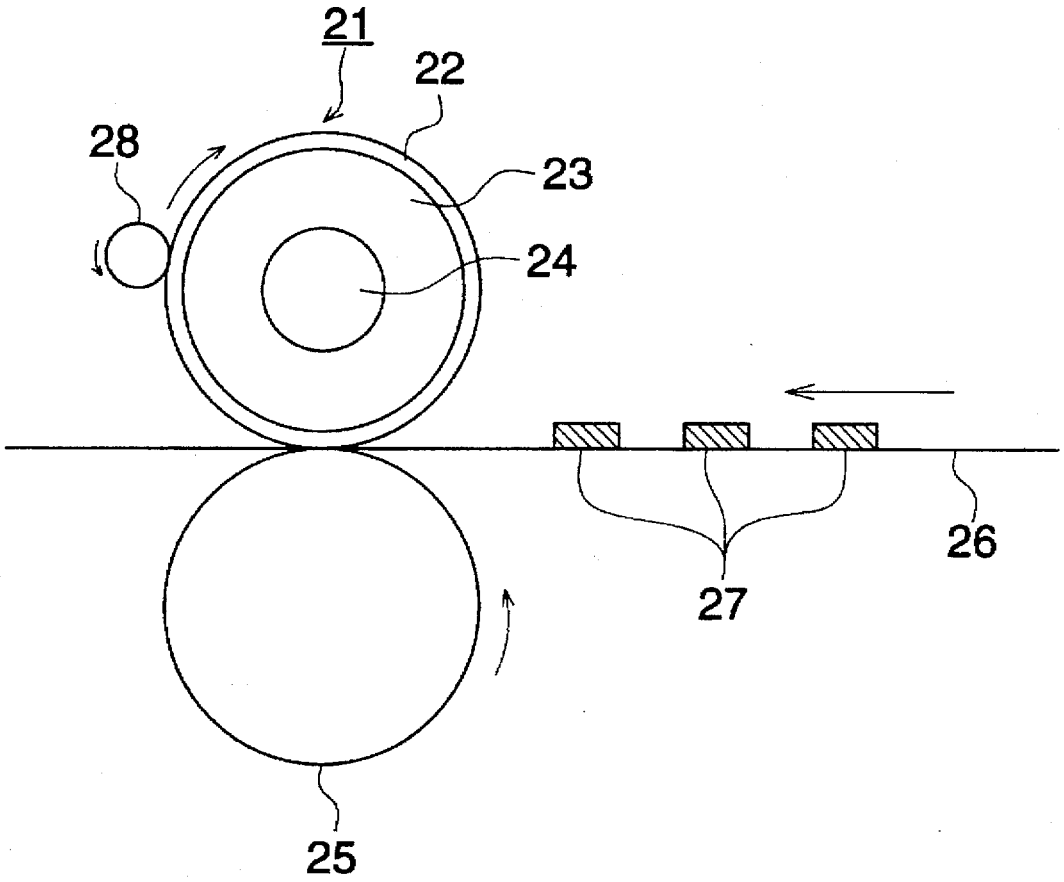
FIG. 3 is a schematic structural diagram for illustrating a heat roller fixing method as an example of a method for fixing toner.

Conditions for fixing (heat roll fixing) by means of a fixing roll housing therein a heating member There was used a fixing means wherein a cylindrical member made of iron having a diameter of 30 mm and housing therein a heater at the central portion thereof and being coated on its surface with a tetrafluoroethylene-perfluoroalkylether copolymer as shown in FIG. 3 was used as an upper roller, and a lower roller with a diameter of 30 mm composed of silicone rubber whose surface was coated likewise with a tetrafluoroethylene-perfluoroalkylether copolymer was provided, and linear load was established at 0.8 kg/cm, while a nip width was set to 4.3 mm, linear speed for printing was set to 250 mm/sec,. and the surface temperature of the fixing means was set to 200° C.

Conditions for fixing by a fixing member of a film-shaped member

An endless sheet fixing means shown in FIG. 1 was used and following fixing conditions were used.

Fixing conditions

Temperature of heating body T1=180° C.

Speed of the film material=250 mm/sec.

Total pressure between the heating body and the pressure roller=15 kg

Nip width between the pressure roller and the film material=3 mm

Film material: 15 μm-thick polyimide film material covered with polytetrafluoroethylene on which conductive materials are dispersed For evaluation, aforesaid means was used and 100,000 prints were made under the conditions of the pixel rate of 5% and ordinary temperature and humidity environment (20° C., 50% RH), then an electrification amount of the developer was measured every 10,000 prints, and existence of image defects (existence of soil caused by offsetting and existence of character dirt and fog) were further evaluated. Table 3 and Table 4 below show the results of the heat roll fixing method and Table 5 and Table 6 show the results of the film type fixing method.

In aforesaid Table 3–Table 6, meanings of A, B and C are as follows. When the defect on the level C took place, the evaluation was discontinued thereafter, resulting in a blank column after that moment.

A: No occurrence of offsetting/character dirt and fog

B: Slight occurrence of offsetting/character dirt and fog

C: Occurrence of offsetting/character dirt and fog

TABLE 3

| Toner No. | Electrification amount (μC/g) | Image soil | Character dirt and fog | Electrification amount (μC/g) | Image soil | Character dirt and fog | Electrification amount (μC/g) | Image soil | Character dirt and fog |
|---|---|---|---|---|---|---|---|---|---|
| | Start | | | 10,000 prints | | | 20,000 prints | | |
| 1 | 15.8 | A | A | 15.2 | A | A | 15.0 | A | A |
| 2 | 23.5 | A | A | 23.2 | A | A | 23.3 | A | A |
| 3 | 14.9 | A | A | 14.5 | A | A | 14.5 | A | A |
| 4 | 21.8 | A | A | 20.5 | A | A | 20.0 | A | A |
| 5 | 22.5 | A | A | 22.1 | A | A | 22.0 | A | A |
| 6 | 20.5 | A | A | 20.1 | A | A | 18.7 | A | A |
| 7 | 16.7 | A | A | 16.3 | A | A | 16.0 | A | A |
| 8 | 18.2 | A | A | 17.7 | A | A | 17.9 | A | A |
| 9 | 19.2 | A | A | 18.6 | A | A | 18.4 | A | A |
| 10 | 14.7 | A | A | 14.2 | A | A | 14.1 | A | A |
| 11 | 17.6 | A | A | 17.1 | A | A | 16.7 | A | A |
| | 30,000 prints | | | 40,000 prints | | | 50,000 prints | | |
| 1 | 14.8 | A | A | 14.9 | A | A | 14.4 | A | A |
| 2 | 22.5 | A | A | 22.9 | A | A | 22.1 | A | A |
| 3 | 14.1 | A | A | 13.6 | A | A | 13.9 | A | A |
| 4 | 19.5 | A | A | 19.7 | A | A | 19.0 | A | A |
| 5 | 21.8 | A | A | 21.6 | A | A | 21.3 | A | A |
| 6 | 19.2 | A | A | 19.0 | A | A | 18.5 | A | A |
| 7 | 15.5 | A | A | 14.9 | A | A | 14.8 | A | A |
| 8 | 17.5 | A | A | 17.1 | A | A | 16.6 | A | A |
| 9 | 18.1 | A | A | 17.8 | A | A | 17.3 | A | A |
| 10 | 14.5 | A | A | 13.7 | A | A | 13.5 | A | A |
| 11 | 16.5 | A | A | 15.7 | A | A | 15.4 | A | A |

TABLE 4

| Toner No. | Electrification amount (μC/g) | Image soil | Character dirt and fog | Electrification amount (μC/g) | Image soil | Character dirt and fog | Electrification amount (μC/g) | Image soil | Character dirt and fog |
|---|---|---|---|---|---|---|---|---|---|
| | Start | | | 10,000 prints | | | 20,000 prints | | |
| 12 | 5.5 | B | C | | | | | | |
| 13 | 24.6 | A | A | 23.1 | A | A | 21.0 | A | B |
| 14 | 11.2 | A | A | 10.1 | A | A | 8.9 | A | B |
| 15 | 10.5 | B | A | 7.7 | C | B | | | |
| 16 | 4.9 | B | C | | | | | | |
| 17 | 5.9 | A | C | | | | | | |
| 18 | 9.6 | A | B | 6.4 | A | B | 4.7 | C | C |
| 19 | 8.8 | A | B | 5.3 | A | C | | | |
| | 30,000 prints | | | 40,000 prints | | | 50,000 prints | | |
| 12 | | | | | | | | | |
| 13 | 19.5 | A | B | 18.2 | A | B | 16.9 | A | B |
| 14 | 6.7 | | | | | | | | |
| 15 | | | | | | | | | |
| 16 | | | | | | | | | |
| 17 | | | | | | | | | |
| 18 | | | | | | | | | |
| 19 | | | | | | | | | |

TABLE 5

| Toner No. | Electrification amount (μC/g) | Image soil | Character dirt and fog | Electrification amount (μC/g) | Image soil | Character dirt and fog | Electrification amount (μC/g) | Image soil | Character dirt and fog |
|---|---|---|---|---|---|---|---|---|---|
| | Start | | | 10,000 prints | | | 20,000 prints | | |
| 1 | 16.0 | A | A | 15.5 | A | A | 15.2 | A | A |
| 2 | 23.3 | A | A | 23.0 | A | A | 23.3 | A | A |
| 3 | 15.0 | A | A | 14.7 | A | A | 14.4 | A | A |
| 4 | 22.3 | A | A | 22.0 | A | A | 22.2 | A | A |
| 5 | 16.3 | A | A | 16.1 | A | A | 15.9 | A | A |
| 6 | 17.9 | A | A | 17.5 | A | A | 17.4 | A | A |
| 7 | 15.1 | A | A | 15.3 | A | A | 14.5 | A | A |
| 8 | 19.3 | A | A | 18.6 | A | A | 18.2 | A | A |
| 9 | 17.4 | A | A | 17.1 | A | A | 16.5 | A | A |
| | 30,000 prints | | | 40,000 prints | | | 50,000 prints | | |
| 1 | 14.7 | A | A | 14.6 | A | A | 14.3 | A | A |
| 2 | 22.4 | A | A | 22.5 | A | A | 22.4 | A | A |
| 3 | 14.0 | A | A | 13.5 | A | A | 13.6 | A | A |
| 4 | 21.6 | A | A | 21.4 | A | A | 21.2 | A | A |
| 5 | 15.5 | A | A | 14.7 | A | A | 14.5 | A | A |
| 6 | 17.3 | A | A | 17.0 | A | A | 16.4 | A | A |
| 7 | 14.1 | A | A | 14.0 | A | A | 13.8 | A | A |
| 8 | 18.0 | A | A | 17.6 | A | A | 17.2 | A | A |
| 9 | 16.3 | A | A | 15.6 | A | A | 15.2 | A | A |

TABLE 6

| Toner No. | Electrification amount (μC/g) | Image soil | Character dirt and fog | Electrification amount (μC/g) | Image soil | Character dirt and fog | Electrification amount (μC/g) | Image soil | Character dirt and fog |
|---|---|---|---|---|---|---|---|---|---|
| | Start | | | 10,000 prints | | | 20,000 prints | | |
| 12 | 5.7 | A | C | | | | | | |
| 13 | 24.3 | A | A | 23.3 | A | B | 21.2 | A | B |
| 14 | 11.0 | A | A | 9.9 | A | B | 8.5 | A | B |
| 15 | 10.7 | B | A | 7.5 | B | C | 6.4 | C | C |
| 16 | 5.1 | B | C | | | | | | |
| 17 | 7.2 | A | B | 4.6 | A | C | | | |

TABLE 6-continued

| Toner No. | Electrification amount (μC/g) | Image soil | Character dirt and fog | Electrification amount (μC/g) | Image soil | Character dirt and fog | Electrification amount (μC/g) | Image soil | Character dirt and fog |
|---|---|---|---|---|---|---|---|---|---|
| 18 | 9.4 | A | B | 6.1 | A | B | 4.9 | A | C |
| 19 | 8.5 | A | B | 5.0 | A | C | | | |
| | 30,000 prints | | | 40,000 prints | | | 50,000 prints | | |
| 12 | | | | | | | | | |
| 13 | 19.4 | A | B | 18.1 | A | B | 16.5 | A | B |
| 14 | 6.7 | B | C | | | | | | |
| 15 | | | | | | | | | |
| 16 | | | | | | | | | |
| 17 | | | | | | | | | |
| 18 | | | | | | | | | |
| 19 | | | | | | | | | |

The present invention provides small particle size toner satisfying uniform and high chargeability and release properties simultaneously and an image forming method employing the same.

We claim:

1. Toner used for developing an electrostatic charge image containing, dispersedly in binding resin, coloring agents, quaternary ammonium salt compound represented by formula (A) having solubility to water of not more than 2.0% and polyolefin whose number-averaged dispersed diameter is 0.1 μm–1.0 μm, wherein the toner satisfies formula (1);

$$17<D_T/D_{CCA}<90 \quad (1)$$

wherein, $D_T$ is a volume-averaged particle size of the toner particle, and $D_{CCA}$ represents a number-averaged diameter of quaternary ammonium salt compound dispersed in a toner particle

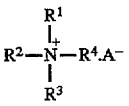

formula (A)

in the above formula, $R^1$, $R^2$, $R^3$ and $R^4$ respectively represent a substituted or unsubstituted alkyl group having 1–18 carbons, or a substituted or unsubstituted benzyl group, provided that at least one of $R^1$, $R^2$, $R^3$ and $R^4$ is an alkyl group having 8–18 carbons, and A represents an anion.

2. A toner according to claim 1 wherein the toner satisfies formula (1);

$$17<D_T/D_{CCA}<85. \quad (1)$$

3. A toner according to claim 3 wherein the toner satisfies formula (1);

$$25<D_T/D_{CCA}<85. \quad (1)$$

4. A toner according to claim 1 wherein an amount of polyolefin in toner is at the rate of 1–5% by weight.

5. A toner according to claim 1 wherein the polyolefin is a low molecular weight polyolefin having number average molecular weight Mn of 800–10,000 and weight average molecular weight of 3,000–50,000.

6. A toner according to claim 1 wherein the polyolefin is polypropylene, polyethylene or ethylene-propylene copolymers.

* * * * *